United States Patent [19]

Thurston et al.

[11] 4,272,849

[45] Jun. 16, 1981

[54] FLEXIBLE FORM FITTING GLOVE

[76] Inventors: Jay D. Thurston, c/o George Spector, 3615 Woolworth Building, 233 Broadway; George Spector, 3615 Woolworth Building, 233 Broadway, both of New York, N.Y. 10007

[21] Appl. No.: 973,866

[22] Filed: Dec. 28, 1978

[51] Int. Cl.[3] ..... A41D 19/00

[52] U.S. Cl. ..... 2/16; 2/161 R

[58] Field of Search ..... 2/16, 21, 161 R

[56] References Cited

U.S. PATENT DOCUMENTS

| | | | |
|---|---|---|---|
| 710,201 | 9/1902 | Lowder | 2/16 X |
| 1,951,190 | 3/1934 | Gambee | 2/161 R |
| 2,737,663 | 3/1956 | Harris | 2/161 R |
| 3,184,756 | 5/1965 | Luca | 2/161 R |
| 3,732,575 | 5/1973 | Pakulak | 2/161 R |

*Primary Examiner*—Louis Rimrodt

[57] ABSTRACT

A glove for being worn by a workman, the glove including stainless steel plates positioned against the backhand side so to protect the hand against being crushed during various work; the glove being made of a flexible material with steel plates located between an outer layer and inner liner so that the glove can be bent at the joint of the fingers; the steel plates accordingly being placed over the rigid segments of the fingers and hand between the joints thereof.

2 Claims, 7 Drawing Figures

FLEXIBLE FORM FITTING GLOVE

This invention relates generally to workman's gloves.

A principal object of the present invention is to provide a glove that is made to protect a workman's hand from being crushed when used on a job wherever such danger exists.

Another object is to provide a protective glove that is form fitting and flexible, so to be comfortable in wear and which allows fingers to flex in order to gasp tools or other objects.

Yet another object is to provide a flexible form fitting glove that includes steel plates positioned over rigid segments of fingers and a hand, which flexing is possible between the steel plates so to accomodate the movements of joints between fingers.

Other objects are to provide a flexible form fitting glove which is simple in design, inexpensive to manufacture, rugged in construction, easy to use and efficient in operation.

These and other objects will be readily evident upon a study of the following specifications and the accompanying drawing wherein.

Figure 1:
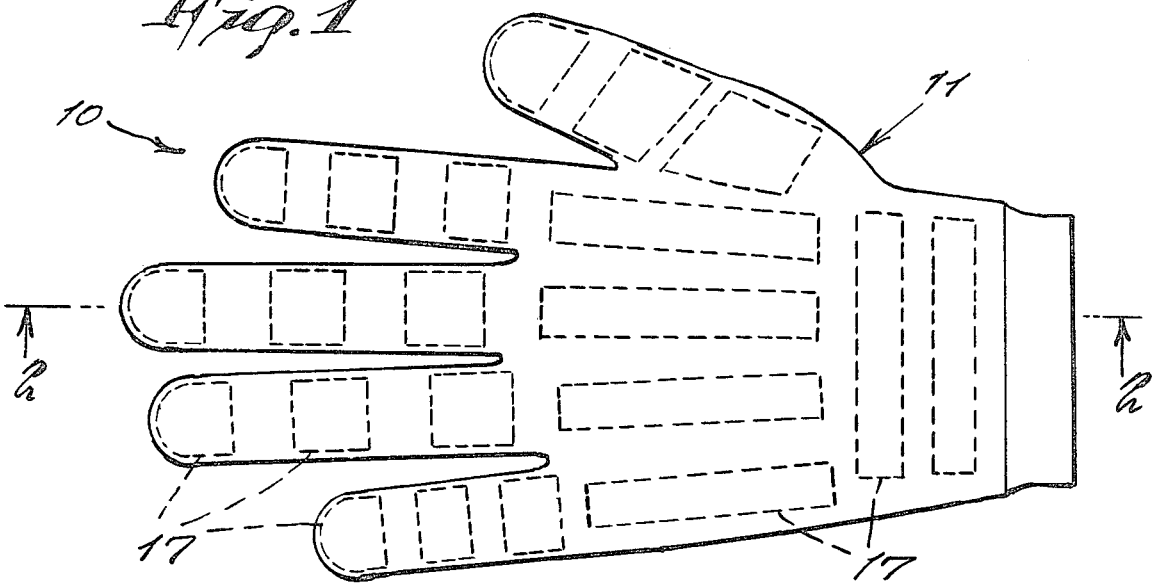
FIG. 1 is a top (or backhand) view of a glove that incorporates the invention of safety steel plates.
Figure 2:
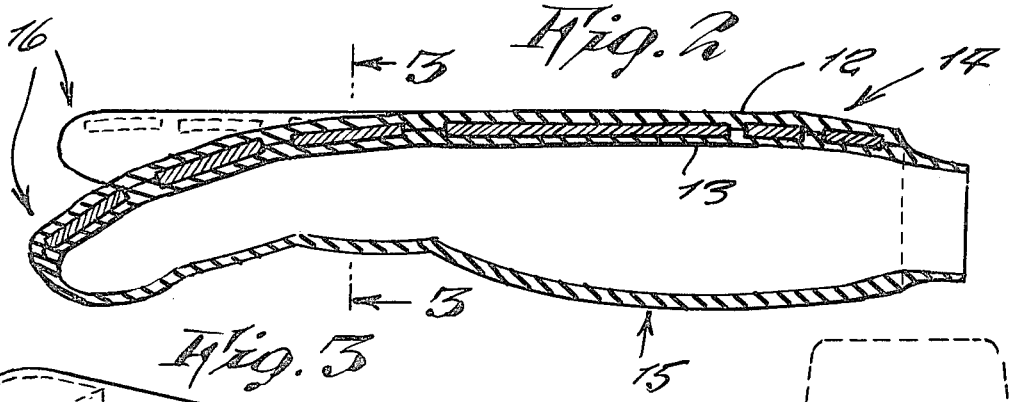
FIG. 2 is a cross section on line 2—2 of FIG. 1.
Figure 3:
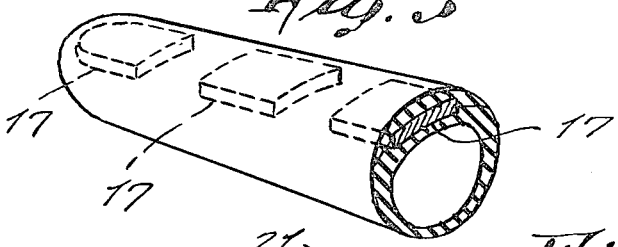
FIG. 3 is a perspective cross sectional view of one of the fingers of the glove.

Refering now to the drawing in greater detail, and more particularly to FIGS. 1 to 3 thereof at this time, the reference numeral 10 represents a flexible form fitting glove according to the present invention wherein there is a flexible glove member 11 that includes an outer layer 12 and an inner liner 13. The outer layer may be made of any tough material such as either leather, canvas or the like in order to not wear out quickly on a job, while the inner liner is made for comfort against a hand, and may accordingly be made either of cotton, flet soft wool or the like. The glove is shaped to enclose a complete hand and fingers so as to therefore include a backhand side 14 and a palm side 15 both of which include thumb and four fingers portions 16 for individually enclosing each thereof.

In the present invention as set of steel plates 17 are fitted on the space 18 between the outer layer and the inner liner. The may be slightly arched, as shown in FIG. 3, and are positioned so to not interfere with the movements of the wearer's finger joints.

In operative use it is now evident that with the plates being placed over the rigid bone portions of the fingers as well as over the back palm, the glove gives a protection against a violent blow against a hand.

Figure 5:
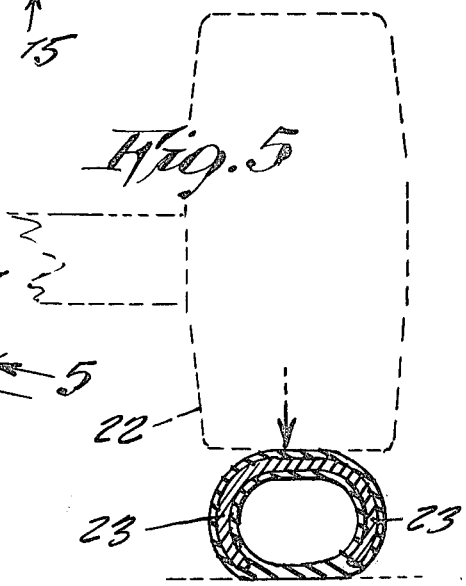
FIG. 5 is a cross section on line 5—5 showing a crushing weight prevented to smash a finger.
Figure 4:
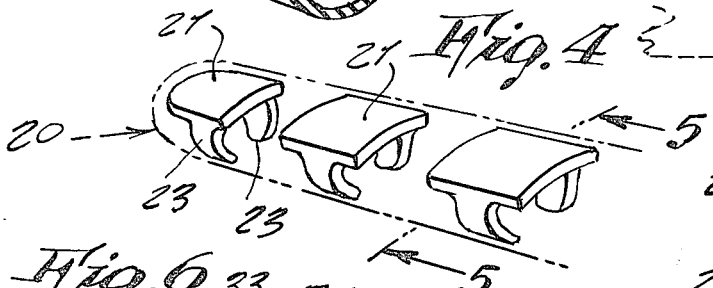
FIG. 4 shows a modified design thereof when each plate wraps on each side of the finger so to prevent the finger from being crushed under a weight, as shown in FIG. 5; the plate still allowing the palm side of the finger to feel an object grasped thereby without any plate interfering with the palm side of the finger.

In FIGS. 4 and 5, a modified design of flecible form fitting glove 20 is a same as glove 10 execpt that the plates 21 are each made to wrap around the sides of the fingers as well as the hand so to additionally protect the same against being crushes, such as by hammer 22. In this design each plate 21 is intergral with side lugs 23 so to bridge around three sides of a finger or hand. Each lug is a sufficient height so to hold a crushing force and thus protect the hand.

Figure 6:
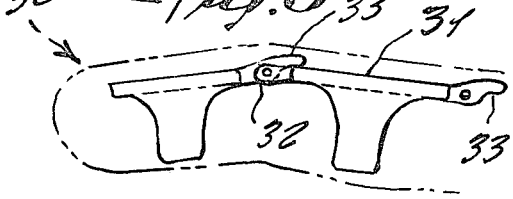
FIG. 6 shows still another design in which the plates hinge together to protect the area between the plates from being hurt such as by a hammer below; a overlap on the hinge portion preventing breaking a hand backward.
Figure 7:
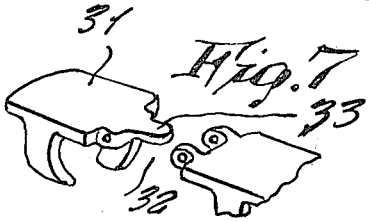
FIG. 7 is a perspective view of the plate shown in FIG. 6.

In FIGS. 6 and 7 a further modified design of flexible form fitting glove 30 has plates 31 which are a same as plates 21 execpt that they are hinged together as shown by hinge 32 therebetween. Additionally a tab 33 of one plate overlaps a next plate so to prevent breaking a hand or finger by excessive back bending force.

While various changes may be made in the detail construction, it is understood that such changes will be within the spirit and scope of the present invention as in defined by the appended claims.

What is claimed is:

1. A flexible, form fitting glove, comprising in combination a flexible glove member including a hand portion and fingers being made of an outer and an inner liner, said cover and liner being made of flexible materials, a space between said cover and liner having a plurably of steel plates so positioned to not interfere with front movements of a wearer, said plate being placed on a back hand side of said glove and located over non-jointed portions of said fingers and hands, wherein each said plate includes a lug on each opposite side to wrap around opposite sides of said fingers wherein said plates are pivotally attached together by hinges including a tab on one end of each plate which overlaps an opposite end of each adjacent plate to limit backward pivotal movement of each plate.

2. A glove as in claim 1 wherein said tab extends between spaced ears forming said hinges on each said opposite end.

* * * * *